US005188541A

United States Patent [19]

Comerci et al.

[11] Patent Number: 5,188,541

[45] Date of Patent: Feb. 23, 1993

[54] ELECTRICAL CABLE TAP SYSTEM

[75] Inventors: Joseph D. Comerci, Elmhurst; Robert DeRoss; Michael J. O'Connell, both of Naperville, all of Ill.; John E. Templeton, Jr., Tuscon, Ariz.

[73] Assignee: Molex Incorporated, Lisle, Ill.

[21] Appl. No.: 804,573

[22] Filed: Dec. 10, 1991

[51] Int. Cl.[5] ..... H01R 13/40

[52] U.S. Cl. ..... 439/596; 439/422; 439/492; 439/499; 439/752

[58] Field of Search ..... 439/404, 411, 421, 422, 439/428, 431, 492, 499, 596, 603, 723, 724, 727, 752

[56] References Cited

U.S. PATENT DOCUMENTS

| | | | |
|---|---|---|---|
| 3,715,705 | 2/1973 | Kuo | 439/422 |
| 3,891,293 | 6/1975 | Jones | 439/422 |
| 4,068,912 | 1/1978 | Hudson, Jr. et al. | 339/99 |
| 4,080,034 | 3/1978 | Werner | 339/98 |
| 4,558,039 | 5/1987 | Marzili | 339/99 |
| 4,950,180 | 8/1990 | Daly et al. | 439/422 |
| 4,975,081 | 12/1990 | Daly et al. | 439/422 |
| 4,997,388 | 3/1991 | Dale | 439/404 |

FOREIGN PATENT DOCUMENTS

| | | | |
|---|---|---|---|
| 0247985 | 10/1990 | Japan | 439/422 |

*Primary Examiner*—Paula A. Bradley
*Attorney, Agent, or Firm*—Stephen Z. Weiss

[57] ABSTRACT

A cable tap system is disclosed for selectively connecting a plurality of tap terminals to a plurality of conductors in either a continuous multi-conductor electrical cable or in two ends of two such cables butt up to one another. A closable cable clamp assembly clamps onto the continuous cable or cable ends. A terminal holder is positionable against one side of the cable clamp assembly and mounts a plurality of tap terminals for interconnection to the conductors of the cable. A backing member is positionable against an opposite side of the cable clamp assembly. A plurality of rotatable fasteners are operatively associated between the terminal holder and the backing member for sandwiching the cable clamp assembly therebetween and maintaining the tap terminals interconnected with the conductors of the cable. A tool is provided for simultaneously rotating the fasteners to close the terminal holder and the backing member in a uniform action.

14 Claims, 3 Drawing Sheets

ELECTRICAL CABLE TAP SYSTEM

FIELD OF THE INVENTION

This invention generally relates to the art of electrical connectors and, particularly, to an electrical cable tap system for making tap, branch or butt connections to conductors of an electrical cable.

BACKGROUND OF THE INVENTION

Electrical cable tap connectors are known for selectively connecting each of a plurality of tap terminals or contacts to each of a plurality of conductors in a multi-conductor cable according to a predetermined wiring scheme. The tap terminals usually are contained in a connector housing and, often, include insulation displacement portions for termination to the cable conductors by piercing the insulation of the cable upon closing of the tap connector.

Examples of such or similar tap connectors or assemblies are shown in U.S. Pat. Nos. 4,068,912 to Hudson et al., dated Jan. 17, 1978; 4,080,034 to Werner, dated Mar. 21, 1978; 4,668,039 to Marzili, dated May 26, 1987 and 4,997,388 to Dale et al., dated Mar. 5, 1991. The principal problems with tap or branch connectors of the character described revolve around the complexity of the assemblies or systems, including the use of a multiplicity of components to effect what otherwise should be a simple procedure of tapping into a multi-conductor cable.

This invention is directed to solving many of the problems in this area by a very simple electrical cable tap system which includes a minimal number of components.

SUMMARY OF THE INVENTION

An object, therefore, of the invention is to provide a new and improved cable tap system for selectively connecting a plurality of tap terminals to a plurality of conductors in a multi-conductor electrical cable.

In the exemplary embodiment of the invention, generally, the cable tap system includes a closable cable clamp assembly for clamping onto the multi-conductor electrical cable. A terminal holder is positionable against one side of the cable clamp and mounts a plurality of tap terminals for interconnection to the conductors of the cable. A backing member is positionable against an opposite side of the cable clamp. Fastening means are operatively associated between the terminal holder and the backing member for closing the cable clamp therebetween and maintaining the tap terminals interconnected with the conductors of the cable.

As disclosed herein, the closable cable clamp assembly is provided in the form of a hinged structure for sandwiching the cable therewithin. The clamp assembly includes passage means therethrough for the fastening means interconnecting the terminal holder and the backing member.

The tap terminals are provided in the form of insulation displacement terminals for termination to the conductors of the cable in response to fastening the terminal holder and the backing member together. The terminals include insulation displacement portions projecting from a back side of the terminal holder. The closable cable clamp assembly includes aperture means for the terminal portions to pass therethrough into termination with the conductors of a clamped cable.

The backing member is provided in the form of a generally flat plate-like member. The fastening means are provided in the form of threaded fasteners on one of the terminal holder and backing member and complementary threaded fastener receptacles on the other of the terminal holder and backing member.

In an alternative embodiment of the invention, ends of two flat cables are inserted into the clamp assembly until the ends abut each other at the midpoint of the clamp assembly. When the clamp assembly is closed it clamps onto the end of each flat cable. When the clamp assembly closed about the two cable end portions is forced into contact with the insulated displacement portion of the terminals, not only when each wire conductor make contact with the insulated displacement terminals but also the conductor of one cable end is terminated to the conductor in the corresponding cable end.

The invention also contemplates the provision of a tool for use in closing an electrical cable tap assembly of the character described, specifically where the tap assembly includes a pair of members closable by a plurality of rotatable fastening means, with the fastening means being disposed concentric about a given axis.

Specifically, the tool includes a frame, and a plurality of rotatable drive heads mounted on the frame in alignment with and respectively engageable with the plurality of fastening means. A drive member is rotatably mounted on the frame for rotation about the axis. The drive member is drivingly engageable with the drive heads to rotate the drive heads simultaneously in response to rotation of the drive member. Means are provided for rotating the drive member.

In the preferred embodiment of the invention, the rotatable drive heads and the drive member have complementarily engageable gear means. The means for rotating the drive member include a first pinion gear member fixed to the drive member on the axis of rotation thereof, and a second pinion gear member rotatably mounted on the frame offset from the axis and meshed with the first pinion gear member. The second pinion gear member has means for receiving a rotating power device.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
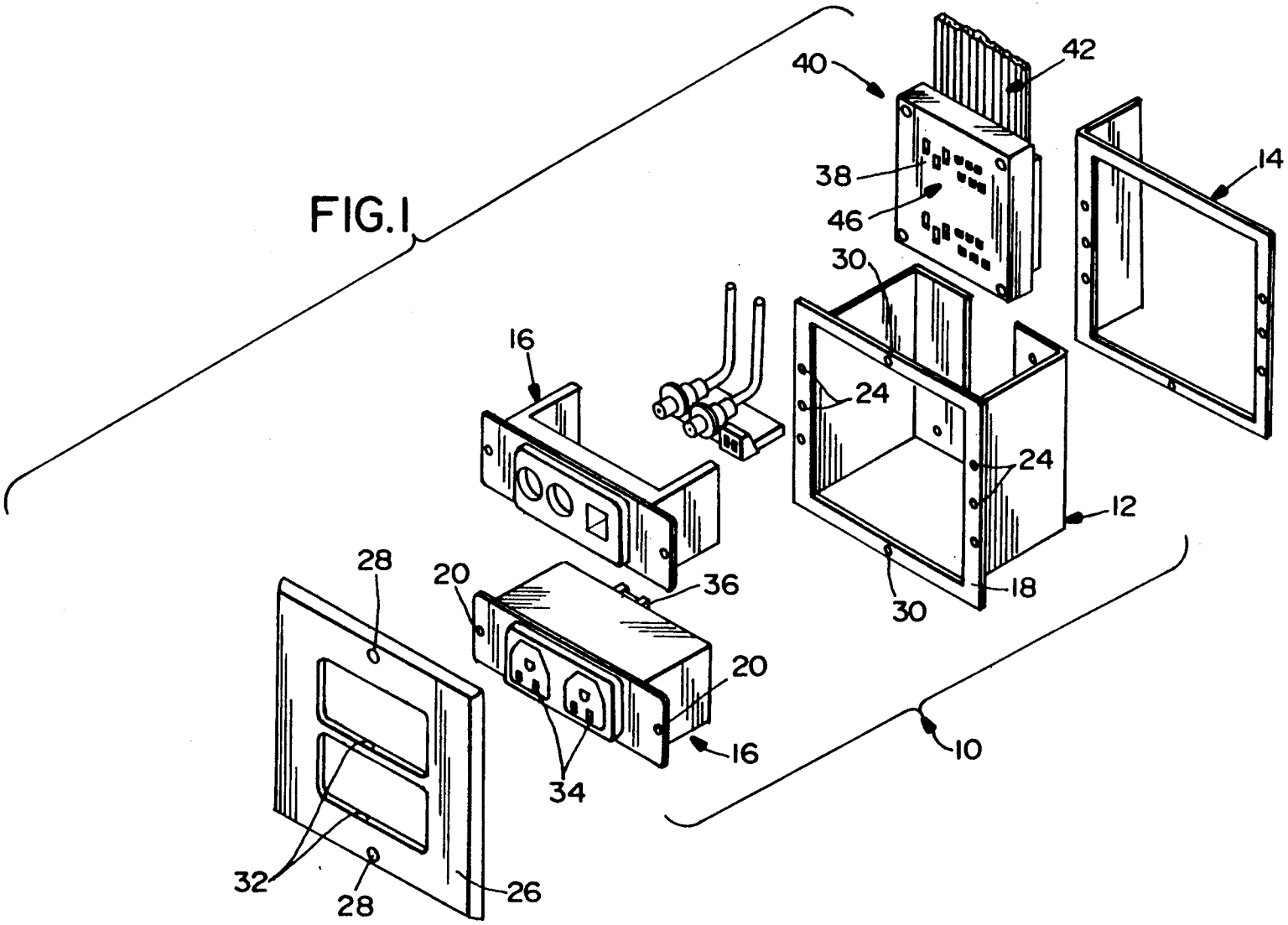
FIG. 1 is an exploded perspective view of a wall or panel mounted receptacle assembly in which the cable tap system of the invention may be incorporated.

Referring to the drawings in greater detail, and first to FIG. 1, a receptacle assembly, generally designated 10, is shown for mounting in a wall, panel or like structure. The components of the assembly are shown somewhat schematically, simply to illustrate an applicable use of the cable tap system of the invention.

More particularly, FIG. 1 shows that receptacle assembly 10 includes a receptacle box, generally designated 12, which may be mounted in an appropriate aperture in a wall or panel by means of a mounting bracket, generally designated 14. One or more receptacle blocks, generally designated 16, are mounted to a peripheral front flange 18 of receptacle box 12 by fasteners extending through apertures 20 in a front flange 22 of each receptacle block 16 and apertures 24 in peripheral front flange 18 of receptacle box 12. A face plate 26 covers the front of the assembly and is fastened by appropriate means to peripheral front flange 18 of receptacle box 12 by means of apertures 28 in the face plate and apertures 30 in peripheral front flange 18. Openings 32 are provided in face plate 26 in alignment with receptacles 34 of receptacle block 16. Receptacles 34 have openings or apertures for receiving the prongs of conventional electric plugs for power and prongs for communication for interconnections with contacts within the receptacles. Portions 36 of the power and communication contacts of the receptacles are shown projecting out the backside of receptacle block 16 for insertion into openings 38 in the front of a cable tap assembly, generally designated 40, embodying the concepts of the invention. Generally, cable tap assembly 40 establishes tap or branch connections with the conductors of a multi-conductor electrical cable, generally designated 42. For instance, multi-conductor cable 42 may be a flat or ribbon cable including a plurality of generally parallel discrete conductors surrounded by insulating material, the surrounding insulating material being joined by integral insulating webs.

Figure 2:
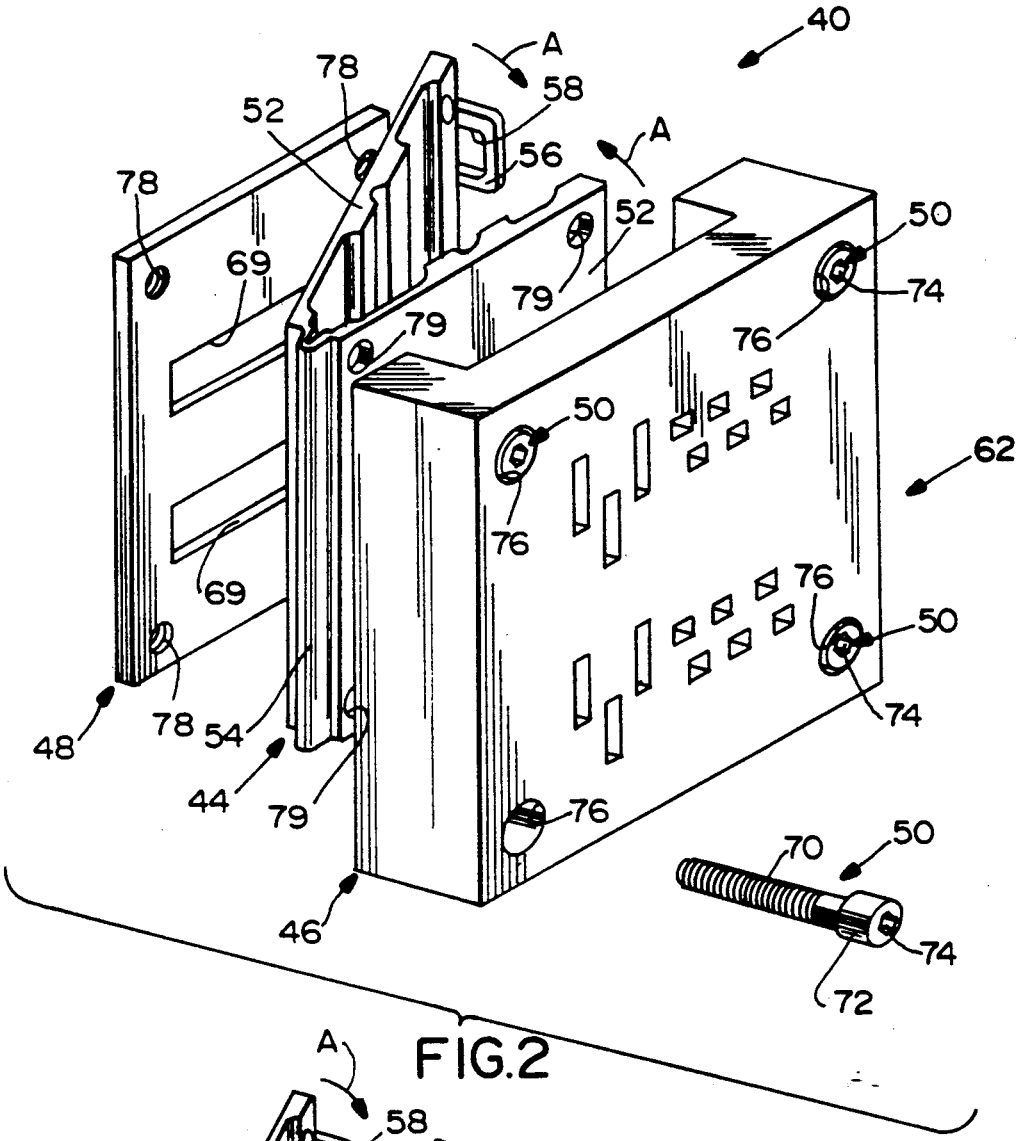
FIG. 2 is an exploded perspective view of the cable tap system or assembly of the invention.

More particularly, referring to FIG. 2, cable tap assembly or system 40 of the invention includes a closable cable clamp assembly, generally designated 44, a terminal holder, generally designated 46, a backing plate-like member, generally designated 48 and a plurality of fasteners, one of which is shown in FIG. 2 and generally designated 50.

Figure 3:
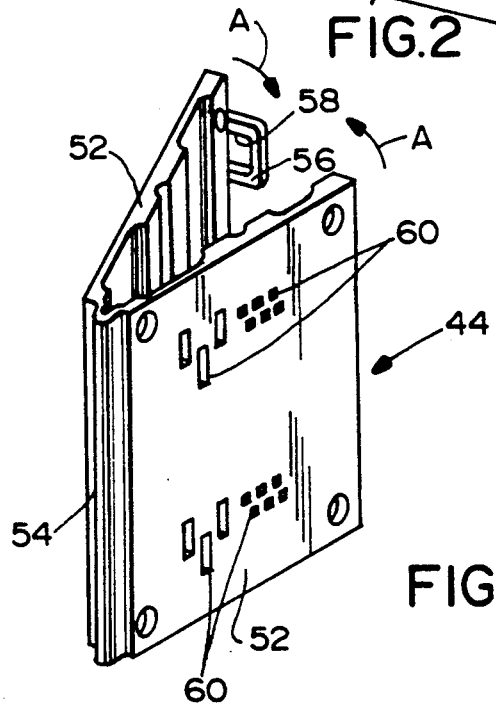
FIG. 3 is a perspective view of the cable clamp assembly of the cable tap system.

Referring to FIG. 3 in conjunction with FIG. 2, closable cable clamp assembly 44 is provided in the form of a unitarily molded plastic device having a pair of walls 52 joined by an integral or living hinge 54. The walls are closable in the direction of arrows "A", about living hinge 54, to sandwich a multi-conductor electrical cable therebetween such as flat cable 42 shown in FIG. 1. Latch arm means 56 may be provided for maintaining cable clamp assembly 44 in closed condition. With the cable clamp assembly being unitarily molded of plastic material, the latch means may be flexible, such as the latch arm 56 shown with an aperture 58 for snapping over a detent latch (not shown) on the adjacent edge of the opposing wall 52 of the cable clamp assembly. As best seen in FIG. 2 in conjunction with FIG. 3, at least the wall 52 which faces terminal holder 46 includes a plurality of passages 60 therethrough and aligned with openings 38 in terminal holder 46, for purposes described below.

Figure 4:
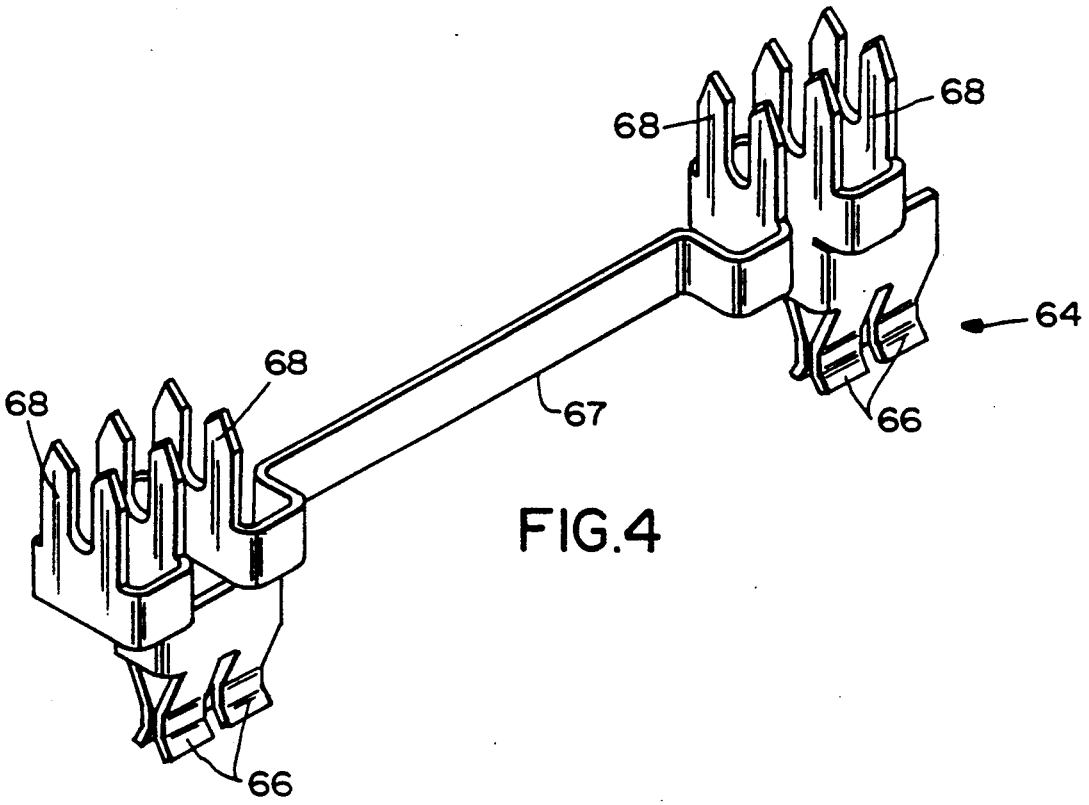
FIG. 4 is a perspective view of an insulation displacement terminal usable in the cable tap assembly.

Terminal holder 46 is provided in the form of a molded plastic housing 62 having the openings 38 therethrough. As stated above, openings 38 are aligned with and of a configuration complementary to terminals 36 (FIG. 1) of receptacle blocks 16. Referring to FIG. 4 in conjunction with FIG. 2, housing 62 of holder 46 appropriately mounts a plurality of terminals, generally designated 64 (FIG. 4). The terminals have female contact portions 66 which are aligned with openings 38 in housing 62 of the terminal holder. The female contact portions receive contact portions 36 (FIG. 1) which extend through appropriate ones of openings 38 in terminal holder housing 62. Each terminal 64 also includes rearwardly projecting, insulation displacement portions 68 which project through passages 60 in front wall 52 of closable cable clamp assembly 44. The insulation displacement portions are designed for piercing the insulation of multi-conductor cable 42 (FIG. 2) to establish electrical connection with the discrete conductors of the cable.

Backing member 48 is provided in the form of a plate-like member fabricated of dielectric material, such as plastic or the like. Therefore, as can be seen in FIG. 2, terminal holder 46 is positionable against one side (the front side as illustrated) of cable clamp assembly 44, and backing plate 48 is positionable against the opposite side (the rear side as illustrated) of the cable clamp assembly. Slots 69 are provided in backing member 48 and through which insulation displacement portions 68 of terminals 64 extend. Although closable clamp assembly 44, terminal holder 46 and backing plate 48 can be fabricated of a variety of configurations, it can be seen that these three simple components can be fabricated of dielectric plastic material in a simple rectangular or square configuration, as might be contemplated for use in a rectangular or square receptacle assembly as shown in FIG. 1. Along with the fastening means described below, these three simple plastic components are all that is required to establish a sound tap or branch interconnection with a multi-conductor cable, such as flat cable 42 shown in FIG. 1.

Generally, fastening means are operatively associated between terminal holder 46 and backing plate 48 for closing cable clamp assembly 44 therebetween and maintaining tap terminals 64 interconnected with the conductors of cable 42. In fact, with tap terminals 64 being of the insulation displacement type, as described above, closing of terminal holder 46 and backing plate 48 onto cable clamp assembly 44 will effect insulation piercing termination between the tap terminals and the cable conductors.

Specifically, the fastening means disclosed herein include a plurality of fastening devices 50 shown in FIG. 2. Each fastening device includes an externally threaded shaft portion 70 and a head portion 72. The head portion has a socket 74 in the distal face thereof. Socket 74 may be of a hex configuration for receiving a driving tool or head. Terminal holder 46 and backing plate 48 are provided with holes 76 and 78, respectively, for receiving fastening devices 50. Holes 76 in terminal holder 46 are countersunk for receiving shaft portions 70 as well as head portions 72 of the fastening devices 50. Holes 78 in backing plate 48 are internally threaded for receiving externally threaded shaft portions 70 of the fastening devices. Cable clamp assembly 44 has holes 79 through which shaft portions 70 of fasteners 50 extend. Therefore, the fastening devices are utilized for closing terminal holder 46 and backing plate 48 against opposite sides of cable clamp assembly 44 to sandwich the cable clamp assembly therebetween in response to rotation of the fastening devices.

Figure 5:
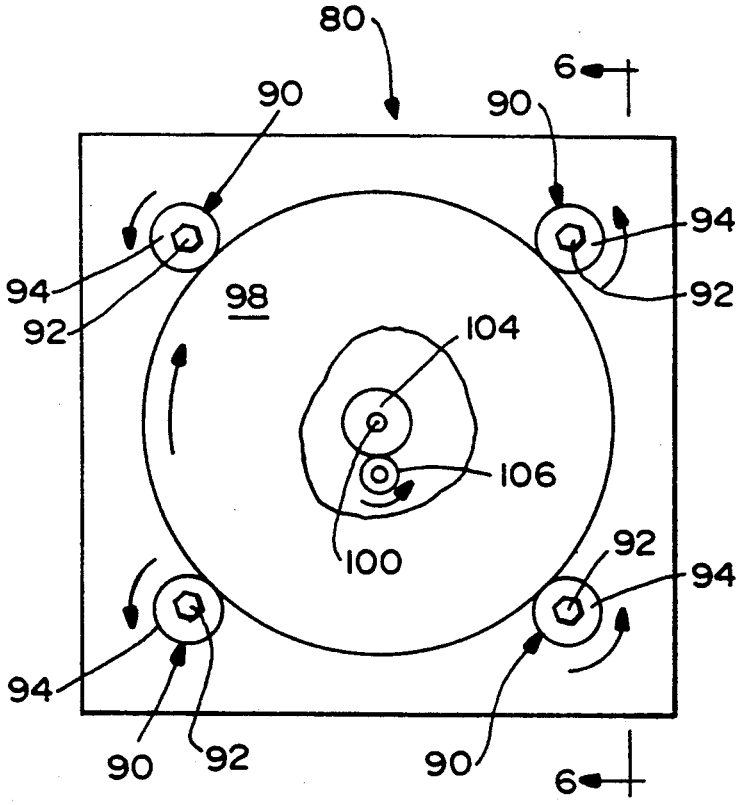
FIG. 5 is a fragmented section of a tool for use in closing the cable tap assembly of FIG. 2, as taken generally along line 5—5 of FIG. 6.
Figure 6:
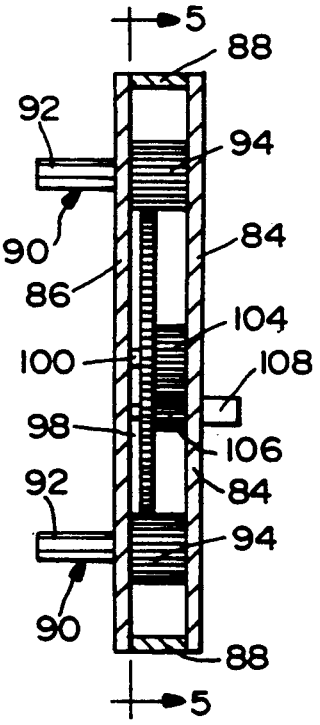
FIG. 6 is a section taken generally along line 6—6 of FIG. 5.

Before proceeding with a description of the tool shown in FIGS. 5 and 6, it can be noted in FIG. 2 that countersunk holes 76 in terminal holder 46 and internally threaded holes 78 in backing plate 48 are arranged in mutual alignment and in a generally square configuration whereby a circle can be drawn through the axis of the holes. In other words, the holes define the corners of a square, with the hypotenuses of the square defining the diameter of the circle.

Now, referring to FIGS. 5 and 6, a tool, generally designated 80, is disclosed for simultaneously rotating fastening devices 50 whereby terminal holder 46 and backing plate 48 are drawn toward each other uniformly to sandwich cable clamp assembly 44 therebetween. In other words, tool 80 obviates a closing action which otherwise would cause terminal holder 46 and backing plate 48 to cant or tilt during closing which might misalign the terminals or otherwise damage the terminals with the discrete wires of the multi-conductor cable.

Tool 80 includes a frame having a front wall 84, a rear wall 86 and sidewalls 88. A plurality of rotatable drive heads, generally designated 90, are rotatably mounted in the frame. Each drive head includes a drive portion 92 and a head portion 94. Drive portion 92 is generally hex-configured for insertion into hex sockets 74 of fastening devices 50. Head portions 94 generally are in the form of gears with gear teeth about the periphery thereof. Bushings 96 are provided in rear wall 86 of the tool frame for accommodating rotation of drive heads 90. The drive heads are located on the tool frame with a spacing and relative alignment which is the same as that of holes 76 and 78 in terminal holder 46 and backing plate 48, respectively, of cable tap assembly 40.

In order to simultaneously rotate drive heads 90, a drive member 98 is rotatably mounted between front and rear walls 84 and 86, respectively, of the tool frame by means of a shaft 100 which defines a central axis of rotation of the drive member. Specifically, the drive member is provided in the form of a disc gear having gear teeth 102 about the periphery thereof and which are in mesh with the gears of head portions 94 of drive heads 90.

Drive gear 98 is rotated by appropriate means which, in the illustrated embodiment of the invention, is provided by a first pinion gear 104 fixed to drive gear 98 on shaft 100 so that rotation of pinion gear 104 effects rotation of drive gear 98. A second pinion gear 106 is rotatably journalled in front wall 84 of the tool frame and has a drive socket 108 projecting outside of the front wall. Second pinion gear 106 is in mesh with first pinion gear 104 which is fixed to drive gear 98. Socket 108 may be of a variety of configurations for receiving a rotating power device. For instance, the socket may be a ¼ inch drive socket for receiving a complementary socket wrench.

With tool 80 as described above in relation to FIGS. 5 and 6, a single rotating power device, such as a socket wrench, can be inserted into socket 108 to rotate pinion gear 106. With pinion gear 106 being in mesh with pinion gear 104 which, in turn, is fixed to drive gear 98, the rotating power device is effective to rotate the drive gear. Rotation of drive gear 98 simultaneously rotates drive heads 90 through gear portions 94 thereof. With the drive heads being drivingly interconnected with fastening devices 50 (FIG. 2), terminal holder 46 and backing plate 48 will be drawn uniformly toward each other to sandwich cable clamp assembly 44 therebetween.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A cable tap system for selectively connecting a plurality of tap terminals to a plurality of conductors in a multi-conductor electrical cable, comprising:

a closable cable clamp assembly for clamping onto the cable;

a terminal holder positionable against one side of the cable clamp assembly and mounting a plurality of tap terminals for interconnection to the conductors of the cable;

a backing member positionable against an opposite side of the cable clamp assembly; and fastening means operatively associated between the terminal holder and the backing member for sandwiching the cable clamp assembly therebetween and maintaining the tap terminals interconnected with the conductors of the cable.

2. The cable tap system of claim 1 wherein said tap terminals are also connected to a plurality of conductors in a second multi-conductor electrical cable where ends of both cables are generally butt together within said clamp assembly.

3. The cable tap system of claim 1 wherein said backing member comprises a generally flat plate-like member.

4. The cable tap system of claim 1 wherein said fastening means comprise threaded fasteners on one of the terminal holder and backing member and complementary threaded fastener receptacles on the other of the terminal holder and backing member.

5. The cable tap system of claim 1 wherein said closable cable clamp assembly includes passage means therethrough for said fastening means.

6. The cable tap system of claim 1 wherein said closable cable clamp assembly comprises a hinged structure for sandwiching the cable therewithin.

7. The cable tap system of claim 6 wherein said closable cable clamp assembly includes passage means therethrough for said fastening means.

8. The cable tap system of claim 1 wherein said tap terminals comprise insulation displacement terminals for termination to the conductors of the cable in response to fastening the terminal holder and the backing member together.

9. The cable tap system of claim 8 wherein said terminals include insulation displacement portions projecting from a back side of the terminal holder, and the closable cable clamp assembly includes aperture means for the terminal portions to pass therethrough into termination with the conductors of a clamped cable.

10. A cable tap system for selectively connecting a plurality of tap terminals to a plurality of conductors in a multi-conductor electrical cable, comprising:

a closable cable clamp assembly for clamping onto the cable, the assembly including a hinged structure for sandwiching the cable therewithin;

a terminal holder positionable against one side of the cable clamp assembly and mounting a plurality of tap terminals for interconnection to the conductors of the cable;

a backing member positionable against an opposite side of the cable clamp assembly; and a plurality of threaded fasteners on one of the terminal holder and backing member and complementary threaded fastener receptacles on the other of the terminal holder and backing member for sandwiching the cable clamp assembly therebetween and maintaining the tap terminals interconnected with the conductors of the cables.

11. The cable tap system of claim 10 wherein said tap terminals are also connected to a plurality of conductors in a second multi-conductor electrical cable where ends of both cables are generally butt together within said clamp assembly.

12. The cable tap system of claim 10 wherein said closable cable clamp assembly includes passage means therethrough for said fastening means.

13. The cable tap system of claim 10 wherein said tap terminals comprise insulation displacement terminals for termination to the conductors of the cable in response to fastening the terminal holder and the backing member together.

14. The cable tap system of claim 13 wherein said terminals include insulation displacement portions projecting from a back side of the terminal holder, and the closable cable clamp assembly includes aperture means for the terminal portions to pass therethrough into termination with the conductors of a clamped cable.

* * * * *